US008181898B2

(12) United States Patent
Lombardini

(10) Patent No.: US 8,181,898 B2
(45) Date of Patent: May 22, 2012

(54) WINDING PLANT FOR USE IN PLASTIC FILM PRODUCTION LINES, IN PARTICULAR, EXTENDABLE PLASTIC FILMS, AND WINDING METHOD OF PLASTIC FILM ROLLS

(75) Inventor: Francesco Lombardini, Cameri (IT)

(73) Assignee: Colines S.p.A., Novara (IT)

( * ) Notice: Subject to any disclaimer, the term of this patent is extended or adjusted under 35 U.S.C. 154(b) by 342 days.

(21) Appl. No.: 12/311,019

(22) PCT Filed: Sep. 19, 2007

(86) PCT No.: PCT/IB2007/002811

§ 371 (c)(1),
(2), (4) Date: Jun. 18, 2009

(87) PCT Pub. No.: WO2008/038113

PCT Pub. Date: Apr. 3, 2008

(65) Prior Publication Data

US 2009/0266927 A1 Oct. 29, 2009

(30) Foreign Application Priority Data

Sep. 26, 2006 (IT) ..... MI2006A1814

(51) Int. Cl.
*B65H 19/22* (2006.01)

(52) U.S. Cl. ..... 242/533.4; 242/533.5

(58) Field of Classification Search .... 242/533.4–533.5, 242/559.2

See application file for complete search history.

(56) References Cited

U.S. PATENT DOCUMENTS 3,421,709 A * 1/1969 Breacker et al. ..... 242/532.3
3,752,412 A * 8/1973 Byrt ..... 242/523.1
3,784,122 A * 1/1974 Kataoka ..... 242/525.7

(Continued)

FOREIGN PATENT DOCUMENTS

DE 28 25 154 A1 12/1979
EP 1 580 155 A 9/2005

OTHER PUBLICATIONS

PCT Search Report dated Feb. 6, 2008.

*Primary Examiner* — Sang Kim
(74) *Attorney, Agent, or Firm* — Hedman & Costigan, P.C.; James V. Costigan

(57) ABSTRACT

A winding plant for use in plastic film production lines comprises a plurality of reels (11-14) connected to a star-like reel carrier (15) rotatable around its own axis. According to the invention, said reels (11-14) are arranged around said star-like reel carrier (15) in a manner such that at least a first reel (12) of said plurality of reels is situated in an operative winding position of a film (20) to form a complete roll (21). Said reels (11-14) each comprise a mandrel (26) supported by a tailstock associated with a flange element (16) comprising at least a first and a second notch (23,24), wherein said flange element (16) is rotatable around its own axis in a manner independent from said star-like reel carrier (15) when said tails tocks are released from said mandrels (26), so to bring said first notch (23) to a second unloaded reel (13) and said second notch (24) to a third reel (14) loaded with a roll (21) of film (20).

4 Claims, 3 Drawing Sheets

U.S. PATENT DOCUMENTS 3,892,012 A * 7/1975 Keferstein ..... 242/527.3
4,516,742 A * 5/1985 Townsend ..... 242/533.5
4,667,890 A 5/1987 Gietman, Jr.
5,743,482 A * 4/1998 Suzuki et al. ..... 242/533.4
5,845,867 A * 12/1998 Hould et al. ..... 242/527
6,585,185 B1 * 7/2003 Weiss et al. ..... 242/527.7
2003/0146334 A1 * 8/2003 Fordham ..... 242/527.2
2007/0045464 A1 3/2007 McNeil

* cited by examiner

WINDING PLANT FOR USE IN PLASTIC FILM PRODUCTION LINES, IN PARTICULAR, EXTENDABLE PLASTIC FILMS, AND WINDING METHOD OF PLASTIC FILM ROLLS

The present invention refers to a winding plant for use in plastic film production lines, in particular extendable plastic film, and to a winding method of plastic film rolls.

Extendable plastic film, also called stretch film, is a widely used product in the packing field, representing the most widespread packing type in Europe and in the United States.

There are many applications of such film type which cover most products of common use, both industrially and in domestic environments.

Plastic films are differentiated by their composition, which permits obtaining films with different characteristics including toughness, stretching, ultimate tensile strength, elastic memory, puncture, and so on.

They can be composed of three or more layers constituted, for example, by mixtures of linear low density polyethylene (LLDPE), low density and ultra low density polyethylene (LDPE, VLDPE, ULDPE), metallocene on polyethylene base (mLLDPE), ethylene-vinyl-acetate in different percentages (EVA from 9% to 20%), polypropylene homopolymer, copolymer or terpolymer (PP homo, PP copo, PP ter) or biodegradable materials (Mater-Bi).

There are therefore many different formulations achieved by means of production lines having combinations of two or more extruders in order to obtain stratifications which can satisfy the requirements of the applications to which they are intended.

According to the type and thickness of the film, different application fields can be recognised, the most important of which including food manufacturers, pharmaceutical manufacturers, paper factories, tile and ceramic manufacturers, large distribution, agriculture and domestic use.

Such great variety of use implies an equally wide variety of film types, both regard to composition and thickness, generally variable from 12 μm up to over 100 μm, and additionally from the standpoint of the winding, which presents itself under different forms according to how the film must be subsequently used, i.e. according to a subsequent manual use, in automatic, semi-automatic machines and so forth.

For example, in the case of stretch film rolls for industrial packing, setting aside the film's own mechanical strength and ultimate elongation characteristics, particular automatic packing machines or "palletisers" are used, on which stretch rolls are positioned of well-defined size and weight.

In particular, for this type of application, there are rolls of overall weight of about 12.5 kg which are wound on cardboard cores haying inner diameter of about 76 mm and with a strip width equal to about e 500 mm.

In the same manner, the rolls for manual use have instead cores of inner diameter equal to 50 mm and overall weight of about 2.5 kg, thus resulting more manageable.

One particular need of the sector is therefore the optimisation of the plastic film production line so to obtain the best return of such lines, automating them as much as possible to reduce the error possibility to a minimum, speeding up the production and at the same time preserving the high flexibility characteristics. The flexibility of the lines, in particular, assumes increasing importance if one considers that for reducing to a minimum the enormous logistic expenses for storage, transport and so on, one always tends towards a "just in time" production. One such production strategy is possible only if the plants are capable of offering a flexibility sufficient for producing film rolls which are differentiated by film or winding type, with minimal time loss in particular during the procedures of equipment change, start-up, and unloading of the production lines.

The plastic film production lines comprise extrusion and cooling plants constituted by a variable number of extruders, according to the characteristics which it is desired to give to the product, downstream of which winding plants are positioned which receive the extruded and cooled film and wind it into rolls.

The extrusion and cooling part does not present particular difficulties in terms of flexibility, but with the high costs requires having very high production volumes, considering the fact that the final products have a very limited added value, such that for reaching sufficient operating margins it is necessary to utilise the effects of a large scale production.

To such end, there is the need to produce plastic films at extremely high actual speeds, close to if not greater than 500 m/min.

The winding plants downstream of the extrusion and cooling plants must therefore have a sufficient winding capacity such to provide for the quantity of film produced over time.

The winding of the film at high speeds, therefore, leads to the physiological presence of air trapped between the laps, which in fact makes the subsequent use of the film itself difficult, representing in any case a waste of space in transport.

In fact, the very reduced added value of such products ensures that the transport cost has a considerable affect on the production costs, thus also for this reason, in addition for the practical film usability reasons given above, "hard" and compact rolls are required, i.e. without air interposed between the laps.

In particular, in the case of a stretch film, the very nature of the film (very sticky) moreover renders obligatory the contact winding, i.e. with the "squeezing" of the roll against a motorised cylinder which favours the expulsion of the air inevitably picked up by the film itself in its winding motion around the mandrel.

To increase the line winding capacity, it was therefore found that the winding of so-called "jumbo" rolls was easier; such rolls have a strip equal to 500 mm but outer diameter up to 500 mm and beyond, which even if wound at a reduced speed which favours the side evacuation of the air otherwise present in the laps, keeps the winding capacity high due to their high diameter dimensions.

The need to have high speed productions, then, would impose, in the case of line production of small diameter (i.e. small measurement) rolls for manual use, very frequent changes (unloading of completed roll and loading of a new core), on the order of a few seconds, which have always represented the maximum limit for the production speed of the entire line.

The general object of the present invention is to resolve the abovementioned drawbacks of the prior art in an extremely simple, economical and particularly functional manner.

Another object is that of devising a winding plant for use in plastic film production lines which is capable of ensuring a high production speed, further reducing the necessary times for the above-defined change steps. Not the least object is that of ideating a plastic film winding method in which the steps of unloading a completed roll and loading a new core occur in reduced times.

In view of the aforesaid objects, according to the present invention, it has been though to make a winding plant for use in plastic film production lines and a related winding method having the characteristics set forth in the attached claims.

The structural and functional characteristics of the present invention and the advantages with regard to the prior art will be clearer from an examination of the following description, referred to the attached drawings, which show a winding plant for use in plastic film production lines made according to the innovative principles of the invention itself.

Figure 1:
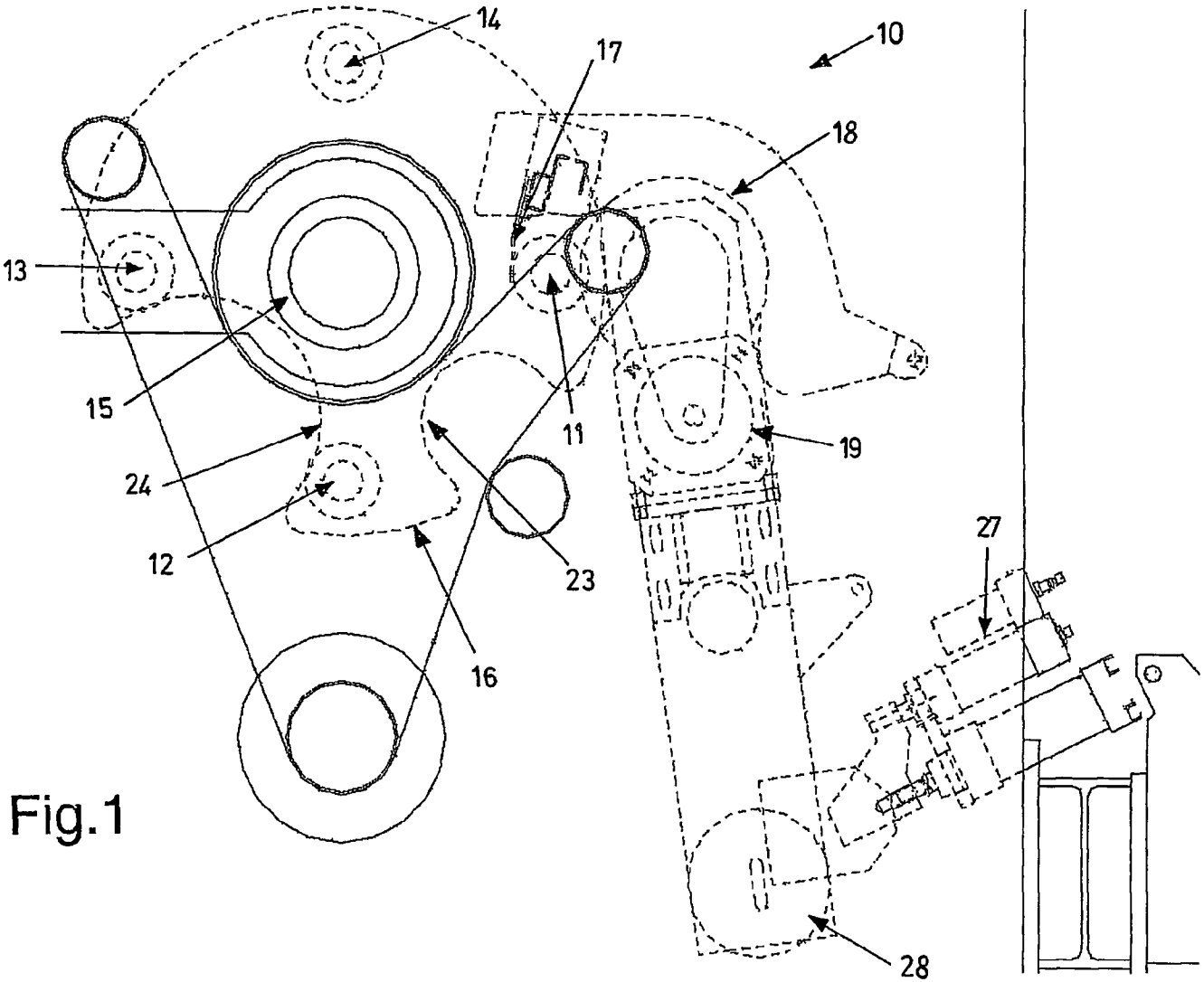
FIG. 1 shows a section view of a winding plant according to the present invention.

With reference to the drawings, the winding plant, object of the invention is indicated overall with 10. Such plant 10 comprises star-like reel carrier 15 to which up to four reels 11-14 are bound, arranged around the star-like reel carrier 15, for example at pitches of 90°, respectively.

Alternatively, three single reels can be provided for, arranged around the star-like reel carrier 15, for example at pitches of 120°, respectively.

At one end of the reels 11-14, a star-like flange 16 is moreover provided which bears the tailstocks (not illustrated) which support the mandrels 26 of the reels 11-14. Such star-like flange 16, substantially with circular surface, has two notches 23, 24 on its perimeter edge which are substantially circular-sector shaped. Such notches 23,24 are appropriately sized so to respectively facilitate the passage of a core 22 around which a film 20 is wound and a completely wound roll 21 of film 20.

At a determined so-called winding angular position, which in the embodiment illustrated corresponds with the position in FIG. 1 of a first reel 11, an appropriate motorisation is provided for, adapted to drive the winding of the film 20 at a determined winding speed around the reel which is found in such angular position, as well as a drawing and pressure device adapted to regulate the tensioning of the film 20 during the winding.

Such drawing and pressure device comprises at least one cylinder 18 which during the winding of the film 20 on the reel is in contact with the respective reel and makes, together with a gummed roller 19, a drawing device of the film 20 itself.

The aforesaid device is free to rotate, during the winding and roll change step, around the axis identified by the torsion bar 28 in order to always maintain the same contact pressure controlled by the pneumatic pistons 27.

Moreover, at the winding position, a blade 17 is provided for, for cutting the film 20 following the end of the winding step of an entire roll 21 of film.

The extraction and re-entry of the transverse cutting blade is controlled by a pair of pneumatic cylinders, not indicated in the figure.

The functioning of the winding plant according to the invention will now be described with reference to an embodiment bearing four reels 11-14.

Figure 2:
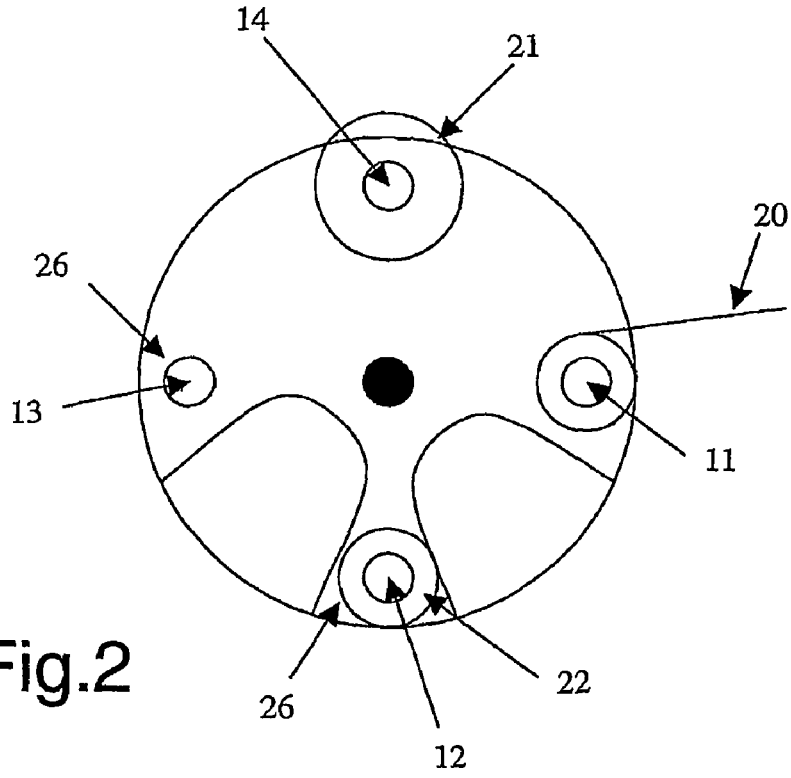
FIG. 2 shows a schematic view of the winding plant of FIG. 1 during the winding step of a first roll.

During the normal functioning, the film 20 is wound on the reel 11 which is found in winding position, i.e. in contact with the drawing and pressure device (see FIG. 2).

As shown in FIG. 2, during the winding of a roll on the reel 11, on a further reel 14 there is present a roll which had been previously wound, which is found in a wait position for the next unloading.

Figure 3:
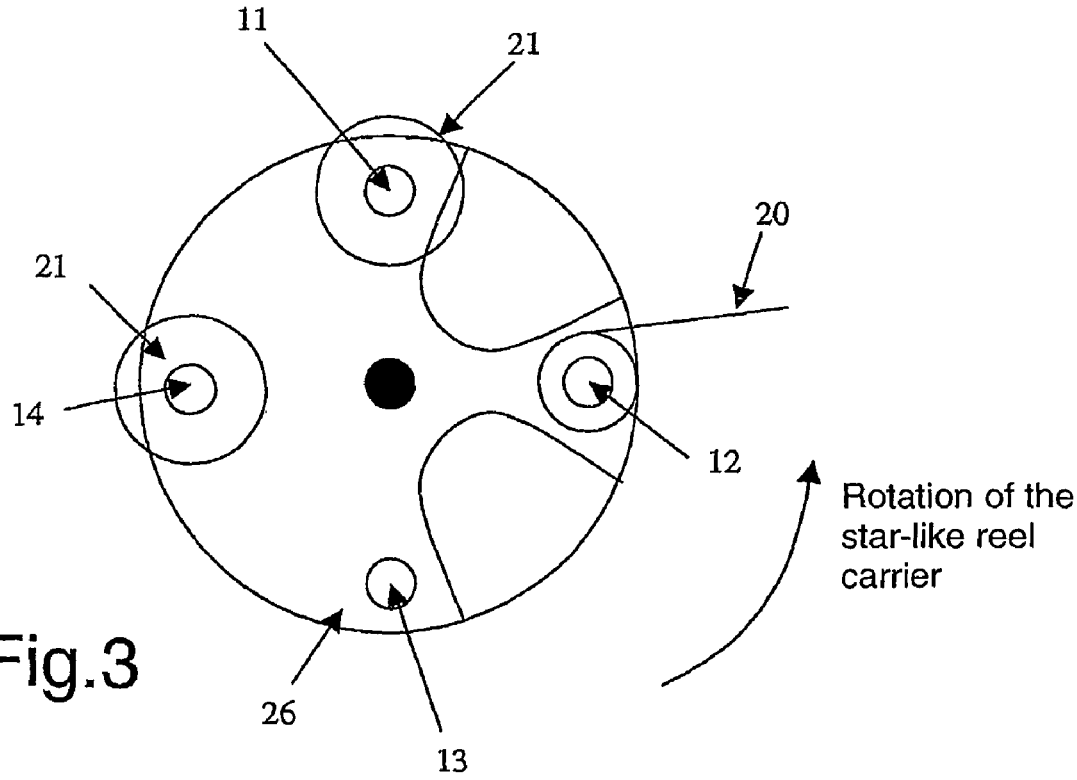
FIG. 3 is a schematic view of the winding plant of FIG. 1 following the winding reel change step.

At the end of such first step, i.e. when the film roll 21 is completed, the so-called change step takes place, in which initially a second reel 12 is wound at a peripheral speed slightly greater than the winding speed and subsequently the star-like reel carrier 15 rotates 90°, for example in anticlockwise sense with reference to the view of FIG. 1, bringing the second reel 12 to the winding position (see FIG. 3).

The rotation speed of the star-like reel carrier 15, adding to the peripheral speed of the reel 11, ensures that the film 20 is further tensioned.

Such rotation moreover brings the film 20 to the blade 17 which, due to the over-tensioning, is capable of cutting the film 20 without risking that it is lost in the passage from the first 11 to the second 12 reel.

To such end, the second reel 12 is moreover preloaded by means of an electrostatic discharge, in such a manner being able to attract the film 20 thereto without the need for glues or adhesives.

As soon as the change step is finished, the star-like flange 16 extracts the tailstocks which support the mandrels 26 and rotates 90°, plus another angular portion depending on the final plant geometry, in the sense opposite to the rotation of the star-like reel carrier 15, so to have notches 23 and 24 respectively at a third reel 13 which is in stand-by and fourth reel 14 bearing the previously wound roll 21 and now ready to be unloaded.

Figure 4:
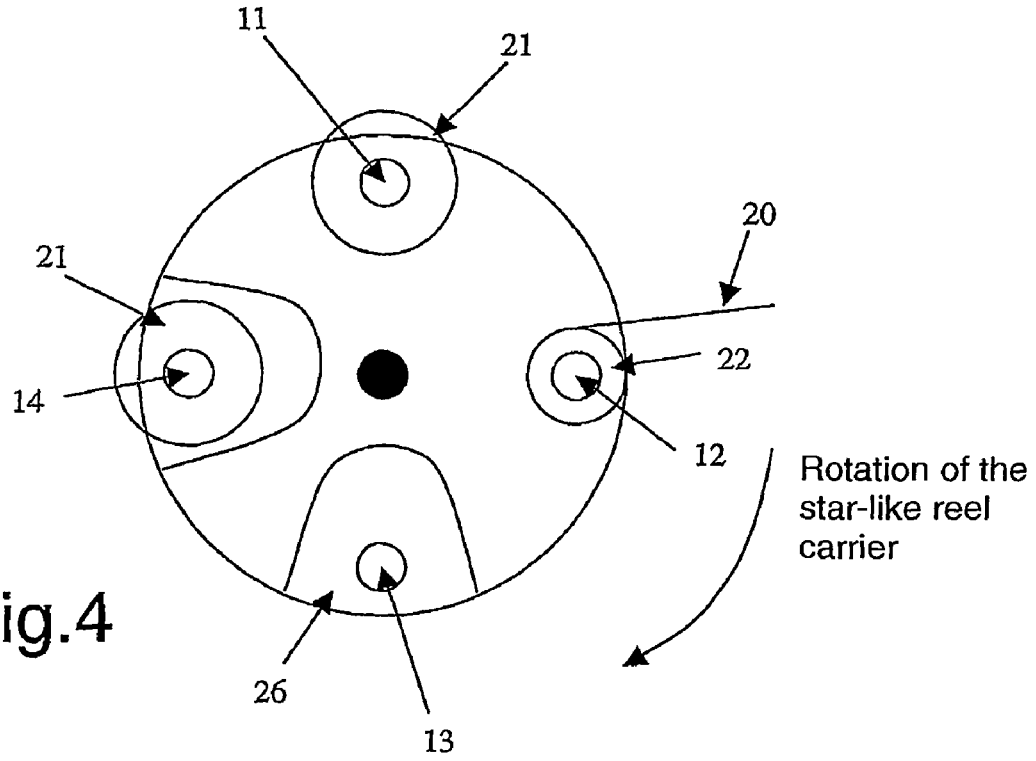
FIG. 4 is a schematic view of the winding plant of FIG. 1 in configuration of unloading a wound roll and loading a new core.
Figure 5:
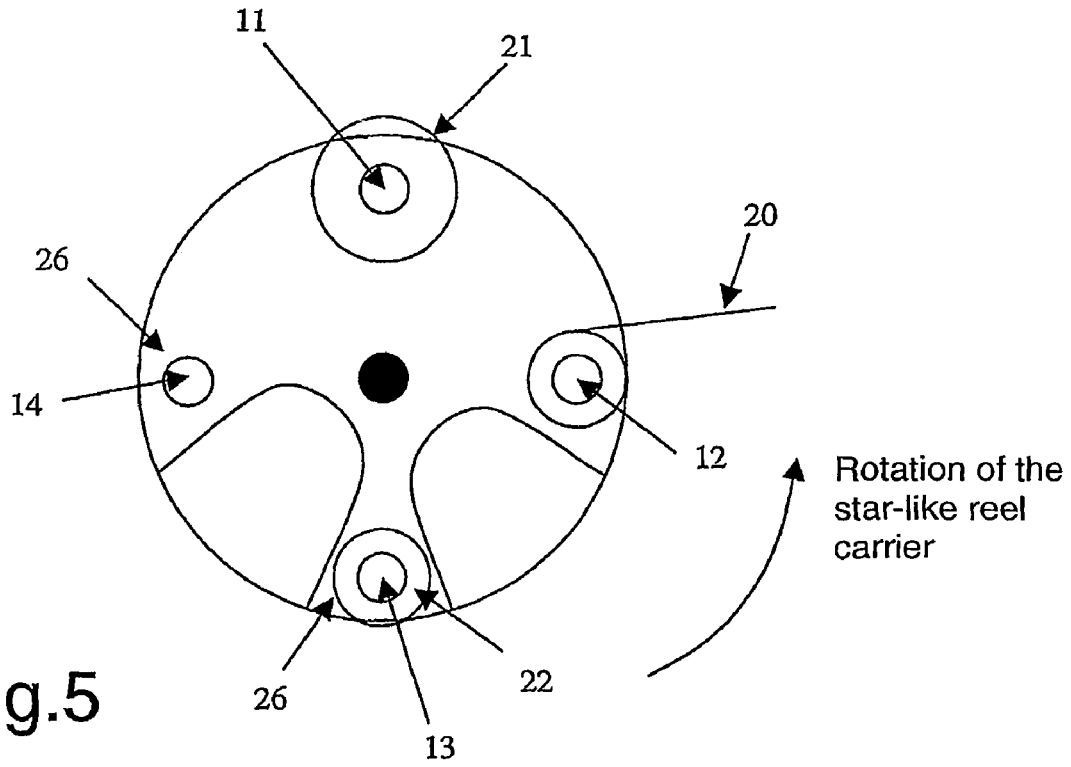
FIG. 5 is a schematic view of the winding plant of FIG. 1 during the winding step of a second roll.

The star-like flange 16 thus positions itself in a manner such to permit the loading of a new core 22 on the third reel 13 and simultaneously the unloading of the previously wound roll 21 on the further reel 14 (see FIG. 4).

During the rotation of the star-like flange 16, the second winding reel 12 is supported by a suitable quick clip system, which provides to maintain its position with suitable characteristics corresponding to the contact cylinder 18.

The completed roll 21 unloading operation and new core 22 loading operation take place simultaneously by means of suitable mechanical actuators which operate at sustained speeds.

Due to the plant according to the invention, such operations generally have a maximum duration of about 15 seconds.

At the end of the simultaneous completed roll 21 unloading and new core 22 loading operations, the star-like flange 16 rotates in the sense opposite that of its initial rotation, so to bring the tailstocks into work position at the nearest mandrel 26.

The entire process described here takes place in very rapid times and it is therefore required that the driving occurs by means of a particularly sensitive control and management device. In such a manner, it is possible to manage the tensions on the film 20 during the change step, such to prevent air-trapping phenomena.

Moreover, to further improve the final aspect of the roll 21, the use of an external rolling device (not shown) is advantageously envisaged, device which acts on the winding roll 21 and which follows it during the change step, in particular when the winding roll 21 is not in contact with the cylinder 17.

Such system is implemented by means of a pneumatic or hydraulic lever system with a high frequency control, so to constantly accompany the motion of the roll 21 during the rotation of the star-like reel carrier 15.

Such rolling system can be constituted by a single additional contact roller which acts exclusively on the roll in winding step, integral therefore with the fixed structure of the machine: the movement, is characterised by different degrees of freedom since it must follow the rotary motion of the star-like reel carrier 15, which however cannot have the axial rotation centre with the rolling system itself.

Alternatively, the rolling can be carried out with the use of an additional roller for every single reel, hence integral with the star-like reel carrier and equipped with a system of approaching and contact with the roll composed of a simpler leverage.

From that described above with reference to the figures, it is evident how a winding plant for use in plastic film production lines according to the invention is particularly useful and advantageous. The object mentioned in the description preamble is thus attained.

With the winding plant according to the invention it is possible to produce plastic film rolls with extremely reduced measurements due to the rapid times necessary for the operations of unloading the completed rolls and loading new cores which, in the described plant, can take place simultaneously.

The winding plant according to the invention can be prearranged both for winding rolls with inner core equal to 50 mm, i.e. of rolls for manual use, and for the winding of rolls on 76 mm cores, i.e. rolls for use on automatic machines, thus offering a high level of flexibility.

It can also be used in pairs with a checkerboard arrangement of the winders, which also permits the simultaneous production of two rolls on 50 mm mandrels and two rolls on 76 mm mandrels, further increasing the flexibility of the production lines, due to the possibility to differentiate the final manufacturing results without changing any line parameter.

The protective scope of the invention is therefore defined by the attached claims.

The invention claimed is:

1. A winding plant for use in plastic film production lines comprising a plurality of reels (11-14) connected to a star-like reel carrier (15) rotatable around its own axis in a clockwise and a counterclockwise direction, said reels (11-14) being arranged around said star-like reel (15) in a manner such that a first reel (12) of said plurality of reels is situated in an operative winding position of a film (20) to form a complete roll (21), said reels (11-14) each comprising a mandrel (26) supported by a tailstock associated with a star-like flange element (16) comprising a first and a second notch (23,24), wherein said flange element (16) is rotatable around its own axis in a clockwise and a counterclockwise direction in a manner independent from said star-like reel carrier (15) when said tailstocks are released from said mandrels (26), so as to bring said first notch (23) to a second unloaded reel (13) and said second notch (24) to a third reel (14) loaded with a roll (21) of film (20) wherein said first notch (23) is circular-sector shaped and has a size substantially similar to the section size of a mandrel (26) or has a size substantially similar to a complete roll; said winding plant also including a drawing and pressure device comprising at least one cylinder (18) arranged in contact with said first reel (12) in operative winding position, said drawing and pressure device being rotatable around a torsion axis (28) and being controlled under pressure through cylinders (27).

2. The winding plant for use in plastic film production lines according to claim 1, characterised in that it comprises a blade element (17) for the cutting of said film (20) following the completion of said roll (21).

3. A method for driving a winding plant for use in plastic film production lines according to claim 1, comprising the steps which consist of:

a) bringing said first reel (12) loaded with said core (22) into winding position and winding said film (20) around said core (22) at a winding speed;

b) releasing said tailstocks from said mandrels (26);

c) rotating said star-like flange element (16) counterclockwise to bring said first notch (23) to said second unloaded reel (13) and said second notch (24) to said third reel (14) loaded with a complete roll (21) of film (20);

d) unloading said complete roll (21) from said third reel (14) and simultaneously loading a new core(22) on said second reel (13); and e) rotating said star-like flange element (16) clockwise so as to bring said tailstocks to couple with said mandrels (26).

4. The method for driving a winding plant according to claim 3, characterised in that it additionally comprises the step which consists of:

f) starting said second reel (13) loaded with said core (22) at a peripheral speed which is greater than said winding speed.

* * * * *